United States Patent [19]

Workman

[11] Patent Number: 4,910,410

[45] Date of Patent: Mar. 20, 1990

[54] ARTICLE ORIENTATION BY SENSING BEAM ARRIVAL TIMES AT PLURAL DETECTORS

[75] Inventor: John Workman, Filton, England

[73] Assignee: British Aerospace plc, London, England

[21] Appl. No.: 254,102

[22] Filed: Oct. 6, 1988

[30] Foreign Application Priority Data

Oct. 14, 1987 [GB] United Kingdom ..... 8724077

[51] Int. Cl.[4] ..... G01N 21/86

[52] U.S. Cl. ..... 250/561; 356/152

[58] Field of Search ..... 250/560, 561; 356/141, 356/152, 375, 400

[56] References Cited

U.S. PATENT DOCUMENTS

| | | | |
|---|---|---|---|
| 3,709,276 | 2/1974 | Cook et al. | 356/152 |
| 4,020,339 | 4/1977 | Gustafson | 356/152 |
| 4,287,412 | 9/1981 | Couderc et al. | 356/152 |
| 4,406,949 | 9/1983 | Spohnheimer | 250/561 |
| 4,524,280 | 6/1985 | Ishikawa | 356/400 |
| 4,626,100 | 12/1986 | Johnson | 356/152 |
| 4,627,724 | 12/1986 | Cameron | 356/152 |

*Primary Examiner*—David C. Nelms

*Attorney, Agent, or Firm*—Nixon & Vanderhye

[57] ABSTRACT

A technique for providing roll orientation information for a course corrected projectile in which the projectile is provided with three off-axis detectors subjected to a scanning laser beam. The time which elapses between the laser beam travelling from one detector to another is all that is required to calculate the roll orientation of the projectile.

11 Claims, 2 Drawing Sheets

$|r_a + r_b| = |r_a' + r_b'|$ $a, b = 1, 2, 3$

ARTICLE ORIENTATION BY SENSING BEAM ARRIVAL TIMES AT PLURAL DETECTORS

The present invention relates to determining the orientation of an article and relates particularly, but not exclusively, to determining the roll orientation of an article which rolls during flight.

In particular, the present invention aims to solve the problem of providing an unambiguous vertical reference for an article which rolls during flight, such as a guided projectile.

According to the present invention we provide an article comprising at least three detectors for detecting a beam of electromagnetic radiation swept across the article wherein the detectors are so positioned as to enable calculation of the orientation of the article solely from the beam transit times between the detectors.

Preferably, the article comprises a plurality of detectors which are offset from a central axis of the article.

In the embodiment to be described the detectors are all positioned at the same radial distance from the central axis of the article. In that embodiment, the detectors are equiangularly spaced around the central axis of the article. Thus in the case of three detectors, the detectors are equiangularly spaced at 120°.

Preferably, the article comprises means for calculating its roll orientation. Thus the invention may be applicable in a projectile housing electronics for utilising signals derived from the detectors to calculate roll orientation. Alternatively, calculation of roll orientation may be carried out remotely using signals from the detectors.

The article may comprise means for sensing the order in which the beam impinges on the detectors. This is one way of overcoming a possible 180° ambiguity in the roll orientation calculated using signals from three detectors.

According to another aspect of the present invention we provide a system for determining the orientation of an article as defined above comprising means for sweeping a beam of electromagnetic radiation across the article and means for calculating the orienation solely from the beam transit times between the detectors.

Preferably, the system comprises means for evaluating the order in which the beam impinges on the detectors.

The system may comprise means for scanning a beam of electromagnetic radiation so as to define an information field. UK Patent No. 2133652B describes apparatus for generating a laser information field for guiding a projectile.

As background, a laser information field can be generated by scanning a laser beam, first horizontally and then vertically, over an angular segment of the sky. By way of example, the horizontal scanning may take the form of scanning the beam along a horizontal line and then dropping the beam slightly and carrying out a return scan at the same speed to just below where the first scan commenced, dropping the beam again and scanning across and so on. The vertical scan may be carried out in the same manner. A projectile flying in the laser informationn field derives information regarding its position in the laser information field from the time which elapses between glimpses of the horizontally and vertically scanning laser beams as is fully explained in UK Patent No. 2133652B.

The present invention may be implemented by supplementing a laser information field detector by two further detectors so that all three detectors are positioned at a fixed radius from the flight axis of the projectile. Alternatively, the laser information field detector may be positioned on the flight axis and three detectors located around it. Referencing is likely to take place at ranges of 1Km or more when the angle subtended by the projectile will be small. Therefore, the rate of angular scan of the laser is desirably adjusted from that of a standard laser information field scan by appropriate adaptation of the control electronics of the laser information field deflector which may be an acousto-optic deflector.

A particular embodiment of the present invention will now be described, by way of example with reference to the accompanying drawings in which.

Figure 1:
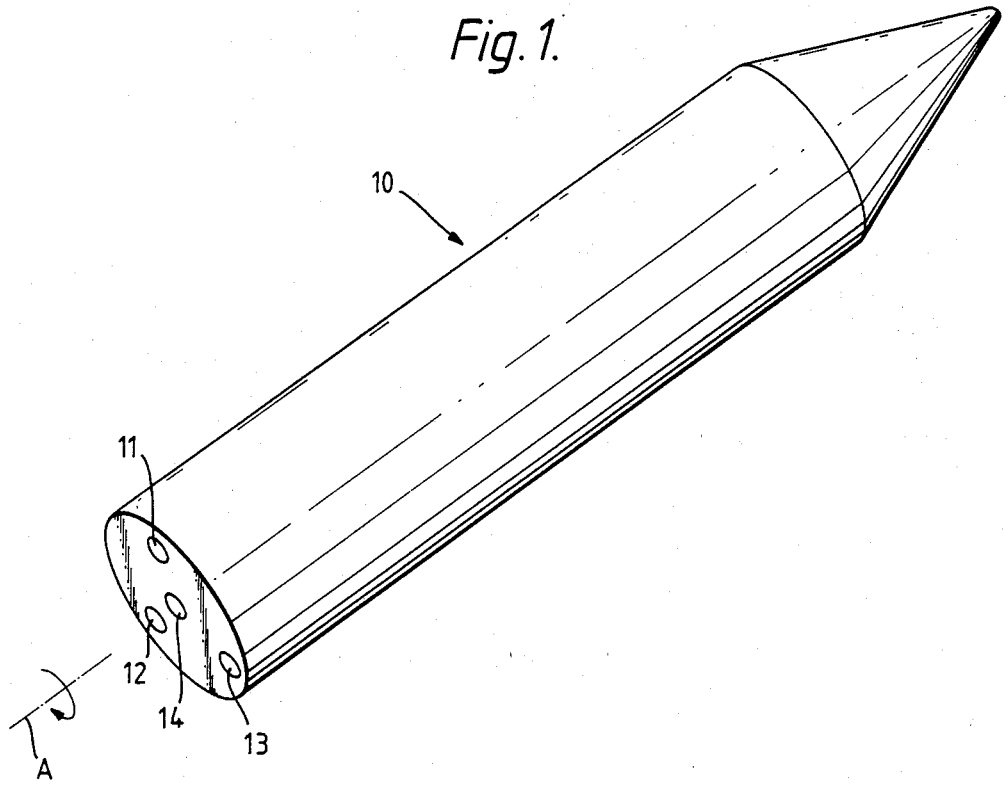
FIG. 1 is a diagram of a projectile according to the present invention.
Figure 3:
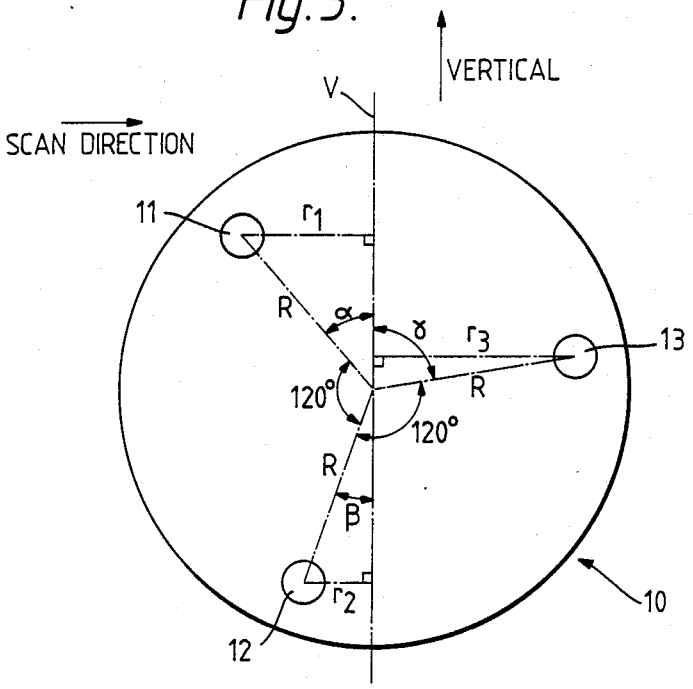
FIG. 3 is a diagram showing the location of the detectors in a projectile according to the present invention.
Figure 4:
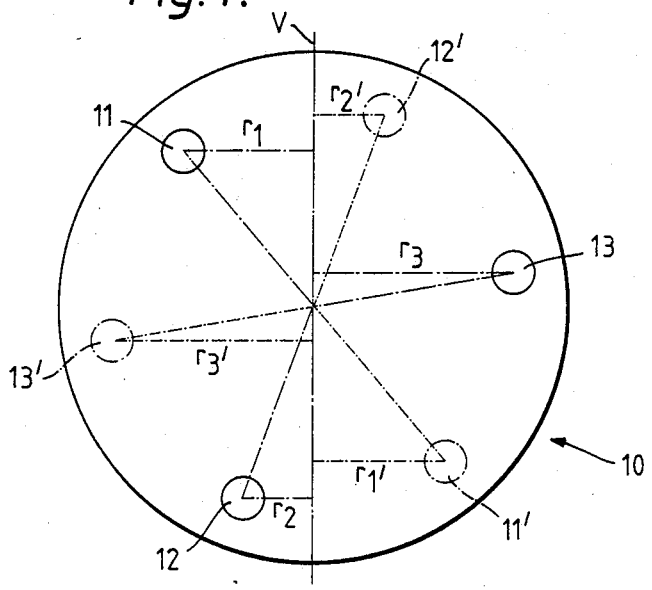
FIG. 4 is similar to FIG. 3 and indicates the position of the detectors rotated through 180° from their original positions.

Referring to FIGS. 1 and 3, a projectile is indicated at 10 and the flight axis is indicated at A. The projectile 10 may, for example, be a course corrected shell provided with fins (not shown) for implementing course corrections during flight. Three equiangularly spaced detectors 11, 12 and 13 are all positioned at a distance R from the flight axis A. The distance of each detector 11, 12 and 13 from the vertical axis V intersecting the flight axis A is designated $r_1$, $r_2$ and $r_3$. A fourth detector 14 is positioned on the flight axis A and this is a laser information field detector.

Figure 2:
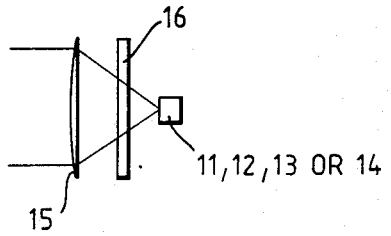
FIG. 2 is a diagram of a part of the projectile of FIG. 1.

The detectors 11 to 14 are photodiodes having a suitable spectral response and have a fast response time—in the order of nano-seconds. Referring to FIG. 2, a lens 15 is associated with each of the detectors so as to increase the light gathering area for that detector and there is an optical filter 16 aligned with the detector for filtering out background radiation.

During flight, the projectile 10 rolls and it is important to know the roll orientation of the projectile when implementing course corrections. In the case of a projectile being guided by a laser information field e.g. of the type disclosed in UK Patent No. 2133652B, the laser information field generating apparatus can be used to implement the present invention.

For the purposes of the following explanation it will be assumed that the range of the projectile from the laser beam projector is sufficiently large that the beam is much larger than the rear of the projectile on which the detectors are mounted and that the effects of beam curvature can be ignored.

As a laser beam is scanned across the detectors 11, 12 and 13, the time at which each detector glimpses the beam will be related to the position of that detector in relation to the vertical axis of the laser information field. Quite clearly, this position will vary as the projectile rotates. Either horizontal or vertical scanning can equally well be used, but horizontal scanning will be referred to here.

At any given time, the positions of each detector, 11, 12 and 13, relative to the vertical axis may be described in terms of the angles $\alpha$, $\beta$, $\gamma$, and the distances $r_1$, $r_2$ and $r_3$ as shown in FIG. 1. Simple trigonometry gives the following set of relationships:

$$\left.\begin{aligned} r_1 &= R \sin \alpha \\ r_2 &= R \sin \beta \\ r_3 &= R \sin \gamma \end{aligned}\right\} \quad (1)$$

The equiangular spacing of the detectors 11, 12 and 13 means that angles $\alpha$, $\beta$ and $\gamma$ are inter-related so that:

$$r_1 = R \sin \alpha \quad (2)$$

$$r_2 = R \sin (60^\circ - \alpha)$$

$$r_3 = R \sin (300^\circ - \alpha)$$

Consequently, values of r on the right hand side of the projectile are negative.

The transit time t of the laser beam across a given distance $\Delta r$ on the projectile, will be related to the projectile range D and the rate of angular scan ($d\alpha/dt$) as follows:

$$t = \frac{\Delta r}{D \frac{d\Omega}{dt}} = a\Delta r \quad (3)$$

where a is a function of angular scan rate and range.

The actual timing measurements wil be related to the positions of the various detectors by:

$$t = a(r_a - b) \quad (4)$$

It is useful to rearrange equation (2) as follows:

$$r_1 - r_2 = R(1.5 \sin \alpha - 0.866 \cos\alpha) \quad (5)$$

$$r_1 - r_3 = R(1.5 \sin \alpha + 0.866 \cos\alpha)$$

$$r_1 - r_3 = 1.732R \cos \alpha$$

If the time separation measured between detectors are say $t_1$, $t_2$, $t_3$ we may combine equation (5) with equation (4) to give:

$$t_1 = a(r_1 - r_2) \quad (6)$$

$$t_2 = a(r_1 - r_3)$$

$$t_3 = a(r_2 - r_3)$$

In order to remove the constant a, the ratio of separate time intervals can be used to give:

$$\frac{t_1}{t_3} = \frac{r_1 - r_2}{r_2 - r_3} = 0.866 \tan \alpha - 0.5$$

$$\frac{t_2}{t_3} = \frac{r_1 - r_3}{r_2 - r_3} = 0.866 \tan \alpha + 0.5$$

Thus the angle $\alpha$, and hence the roll orientation of the projectile, can be deduced by measuring the transit time of the scanned beam as it passes from one detector to another. The accuracy with which angle can be measured depends on the accuracy with which the times at which the detectors glimpse the laser beam can be measured.

When angle $\alpha$ is small, any errors are more critical and it may be advantageous to scan the beam a second or even third time across the projectile at a suitable time interval, e.g. 1 millisecond.

Equation (3) indicates that the shorter the range the greater the pulse separation so that a measurement at short range will be more accurate than a longer range measurement. Therefore, one possiblity is to use the present invention to calibrate a gyroscope on board a projectile so that the gyroscope can provide roll orientation information from a particular range onwards.

It is desirable for measurements to be made relative to the centre of the scanning beam so that the curvature of the beam does not introduce an error.

In practice, the scanning rate of the laser beam will be in the order of one millisecond per sweep. Therefore the time taken for the beam to cross the projectile is likely to be in the order of microseconds. The roll rate of a course corrected projectile is not likely to exceed 1 Khz.

If offsetting the laser information field detector from the flight axis a of the projectile introduces an undesirable error at the ranges at which guidance information is to be imparted to the shell by the laser information field, then the laser information field detector may be positioned centrally and be supplemented by three circumferentially spaced roll reference detectors.

Referring to FIG. 2, a possible 180° ambiguity exists if only the time intervals are measured as previously described. One way of overcoming this is to determine the order in which the detectors glimpse the beam. Using a simple truth table then removes any ambiguity.

Although the present invention has been described with reference to a laser information field, different scanning equipment may be used. For example, a laser projector which simply sweeps a laser beam across the path of a projectile at predetermined time intervals may be laser beams, e.g. light beams, radar beams or other electromagnetic radiation.

The invention is not limited in its application to course corrected projectiles but may be applied to other forms of guided projectile or to any article which rotates during flight.

The term flight is not intended to limit to airborne vehicles and the invention may have application to space vehicles as mentioned above or to water-borne vehicles.

The invention has been described in terms of providing a vertical reference but may be used to provide any other reference plane as desired.

Furthermore, the invention is also applicable to determining the orientation of non-rotating articles and may, for example, be used to assist in the docking of spacecraft.

I claim:

1. A device for determining orientation of an article comprising:

means for sweeping a beam of electromagnetic radiation across said article;

at least three spaced apart detectors on said article for detecting said beam of electromagnetic radiation swept; and means for calculation of the orientation of the article solely from beam arrival times at each of the detectors.

2. A device according to claim 1 wherein said means for sweeping comprises a horizontal scan and a vertical scan and said detectors are offset from a central axis of the article.

3. A device according to claim 1 or claim 2 wherein the detectors are all positioned at the same radial distance from the central axis of the article.

4. A device according to claim 1 or 2 wherein the detectors are equiangularly spaced around the central axis of the article.

5. A device according to claim 1 or 2 comprising means for sensing the order in which the beam impinges on the detectors.

6. A device according to claim 1 or 2 comprising filter means for filtering out background radiation.

7. A device according to claim 1 or 2 which rolls during flight comprising means for calculating its roll orientation.

8. A device according to claim 7 further including a gyroscope for providing roll orientation information at relatively long range from the source of the beam.

9. A method for determining the orientation of an article comprising the steps of:

providing at least three spaced apart detectors on said article;

sweeping a beam of electromagnetic radiation across each of said detectors on the article; and calculating the orientation of the article solely from beam arrival times at the detectors.

10. A method according to claim 9, wherein said calculating step includes the step of evaluating the order in which the beam impinges on the detectors.

11. A method according to claim 9 or claim 10, wherein said scanning step comprises scanning a beam of electromagnetic radiation so as to define an information field.

* * * * *